US009174829B2

(12) United States Patent
Shaw

(10) Patent No.: US 9,174,829 B2
(45) Date of Patent: Nov. 3, 2015

(54) ADJUSTABLE WHEEL RACK

(71) Applicant: MVP (HK) Industries, Inc., Kowloon (HK)

(72) Inventor: William Shaw, Santa Clara, CA (US)

(73) Assignee: MVP (HK) Industries, Inc., Kowloon (HK)

( * ) Notice: Subject to any disclaimer, the term of this patent is extended or adjusted under 35 U.S.C. 154(b) by 77 days.

(21) Appl. No.: 14/098,074

(22) Filed: Dec. 5, 2013

(65) Prior Publication Data

US 2015/0096947 A1 Apr. 9, 2015

(30) Foreign Application Priority Data

Oct. 4, 2013 (TW) ..... 102218617 U
Oct. 11, 2013 (CN) ..... 201320625529

(51) Int. Cl.
*A47F 7/04* (2006.01)
*B66F 7/28* (2006.01)

(52) U.S. Cl.
CPC .... *B66F 7/28* (2013.01); *A47F 7/04* (2013.01)

(58) Field of Classification Search
USPC ..... 248/481, 482, 521, 516, 181.1, 181.2, 248/288.31; 211/23, 24
See application file for complete search history.

(56) References Cited

U.S. PATENT DOCUMENTS 566,851 A 9/1896 Ferguson
1,515,690 A 11/1924 Marion
1,688,148 A * 10/1928 Martin ..... 248/229.12
2,175,421 A 4/1938 Wright
2,378,911 A 6/1945 Clark
2,564,510 A 8/1951 Shoemaker
2,674,394 A 9/1951 Hall et al.
2,947,513 A 8/1960 Nolden et al.
3,321,169 A 5/1967 Fowler
3,361,408 A 1/1968 Strang et al.
3,830,387 A 8/1974 Virnig
3,843,033 A 10/1974 Wirth, Sr.
4,042,139 A 8/1977 Pernsteiner et al.
4,052,046 A * 10/1977 Mortoly ..... 269/208

(Continued)

FOREIGN PATENT DOCUMENTS

DE 3540208 C2 4/1993
DE 19607703 A1 9/1997

(Continued)

OTHER PUBLICATIONS

European Patent Application 14167961.3 Extended European Search Report dated Feb. 12, 2015, 5 pages.

(Continued)

*Primary Examiner* — Alfred J Wujciak
(74) *Attorney, Agent, or Firm* — Lathrop & Gage LLP

(57) ABSTRACT

In one embodiment, a wheel rack includes a locking frame plate having a first L-shaped plate, a second L-shaped plate, and a stopper plate. A ball seat is fixed to the locking frame plate, and a rod has a first end with a sphere attached thereto. The locking frame plate is configured to be fixed to a jamb of a vehicle lift. In another embodiment, a wheel rack includes a locking frame plate having a first L-shaped plate, a second L-shaped plate, and a stopper plate. A ball seat is fixed to the locking frame plate. The wheel rack also includes a locking seat and a rod that has an end with a sphere attached thereto. The locking frame plate is configured to be fixed to a jamb of a vehicle lift.

18 Claims, 6 Drawing Sheets

(56) References Cited

U.S. PATENT DOCUMENTS

| | | | | |
|---|---|---|---|---|
| 4,185,801 | A | 1/1980 | Plymoth | |
| 4,270,237 | A | 6/1981 | Breeze, Jr. et al. | |
| 4,600,354 | A | 7/1986 | Niewald et al. | |
| 4,645,181 | A | 2/1987 | Schapansky | |
| 4,650,144 | A | 3/1987 | Conrad | |
| 4,684,310 | A | 8/1987 | Stange | |
| 4,715,477 | A | 12/1987 | Suzuki | |
| 4,771,531 | A | 9/1988 | Asher | |
| D313,544 | S | 1/1991 | Scherer | |
| 5,007,789 | A | 4/1991 | Painter | |
| 5,078,276 | A | 1/1992 | Rogge et al. | |
| 5,121,900 | A | 6/1992 | McDonald | |
| 5,180,274 | A | 1/1993 | Haugen et al. | |
| 5,184,930 | A | 2/1993 | Kuhn | |
| 5,213,297 | A | 5/1993 | Laskowski | |
| D344,868 | S | 3/1994 | Martinell | |
| D357,106 | S | 4/1995 | Francis et al. | |
| 5,464,314 | A | 11/1995 | Laaksonen | |
| 5,618,228 | A | 4/1997 | Anderson | |
| 5,649,582 | A | 7/1997 | Hjorth-Hansen | |
| 5,775,654 | A * | 7/1998 | Price | 248/231.61 |
| 5,813,659 | A | 9/1998 | Heidle | |
| 6,398,174 | B1 | 6/2002 | Emalfarb | |
| 6,604,610 | B2 | 8/2003 | Starling et al. | |
| 6,681,897 | B2 | 1/2004 | Gibson et al. | |
| 6,991,202 | B2 * | 1/2006 | Carmona | 248/229.14 |
| 7,073,778 | B2 | 7/2006 | Gibson et al. | |
| 7,815,158 | B2 | 10/2010 | Henderson | |
| 2003/0155475 | A1 | 8/2003 | Hicks | |
| 2006/0102824 | A1 * | 5/2006 | Carnevali | 248/534 |
| 2008/0099645 | A1 * | 5/2008 | Reichley | 248/285.1 |
| 2009/0060473 | A1 * | 3/2009 | Kohte et al. | 386/124 |
| 2013/0240696 | A1 | 9/2013 | Black et al. | |

FOREIGN PATENT DOCUMENTS

| | | | |
|---|---|---|---|
| EP | 81850203.1 | A2 | 5/1982 |
| EP | 0486431 | A2 | 5/1992 |
| JP | H4-368261 | | 12/1992 |
| WO | 0055031 | A1 | 9/2000 |

OTHER PUBLICATIONS

The Tire Hanger Corporation "Tire Hanger Installation," Retrieved from the Internet http://www.tirehanger.com/install.htm on Jun. 5, 2014, but shows copyright of 2001.

* cited by examiner

ADJUSTABLE WHEEL RACK

CROSS-REFERENCE TO RELATED APPLICATIONS

This application claims priority to Taiwanese patent application number 102218617, filed Oct. 4, 2013; this application also claims priority to Chinese patent application number 201320625529.3, filed Oct. 11, 2013. The disclosures of each are incorporated herein in their entirety by reference.

BACKGROUND

Vehicle lifts come in various sizes. Consequently, add on devices, such as wheel racks, are manufactured specifically for each size of jamb provided with different vehicle lifts. Purchasing a separate wheel rack for each different jamb and/or vehicle lift is expensive and duplicative. Devices and methods set forth herein may provide for an adjustable wheel rack for use with various vehicle lifts and jamb sizes.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a manner that is easily understood as an introduction to the more detailed description which follows.

In one embodiment, a wheel rack includes a locking frame plate having a first L-shaped plate, a second L-shaped plate, and a stopper plate. A ball seat is fixed to the locking frame plate, and a rod has a first end with a sphere attached thereto. The locking frame plate is configured to be fixed to a jamb of a vehicle lift.

In another embodiment, a wheel rack includes a locking frame plate having a first L-shaped plate, a second L-shaped plate, and a stopper plate. A ball seat is fixed to the locking frame plate. The wheel rack also includes a locking seat and a rod that has an end with a sphere attached thereto. The locking frame plate is configured to be fixed to a jamb of a vehicle lift.

In still another embodiment, a method of using a wheel rack includes providing a locking frame plate that includes a first L-shaped plate having a horizontal contact surface and a vertical contact surface, a second L-shaped plate having a horizontal contact surface and a vertical contact surface, and a stopper plate. At least one aperture in the horizontal contact surface of the first L-shaped plate aligns with one aperture in the vertical contact surface of the second L-shaped plate and the plates are securely fastened.

A locking seat, and a rod having a first end and a second end, where a sphere is attached to the first end and a stopper is attached to the second end is provided.

The method further includes providing a ball seat which is fixed to the locking frame plate. The ball seat includes a ball receiving plate having a cavity and a protruding block that is secured to the ball receiving plate. The protruding block has at least one recessed area for accommodating the rod.

The sphere is secured between the cavity of the ball receiving plate and the locking seat, and may be rotated such that the rod is in a substantially perpendicular position relative to the vertical contact surface of the first L-shaped plate. The rod is placed in at the at least one recessed area of the protruding block, and the wheel is placed on the rod.

BRIEF DESCRIPTION OF THE DRAWINGS

Illustrative embodiments of the present invention are described in detail below with reference to the attached drawing figures.

DETAILED DESCRIPTION

Figure 1:
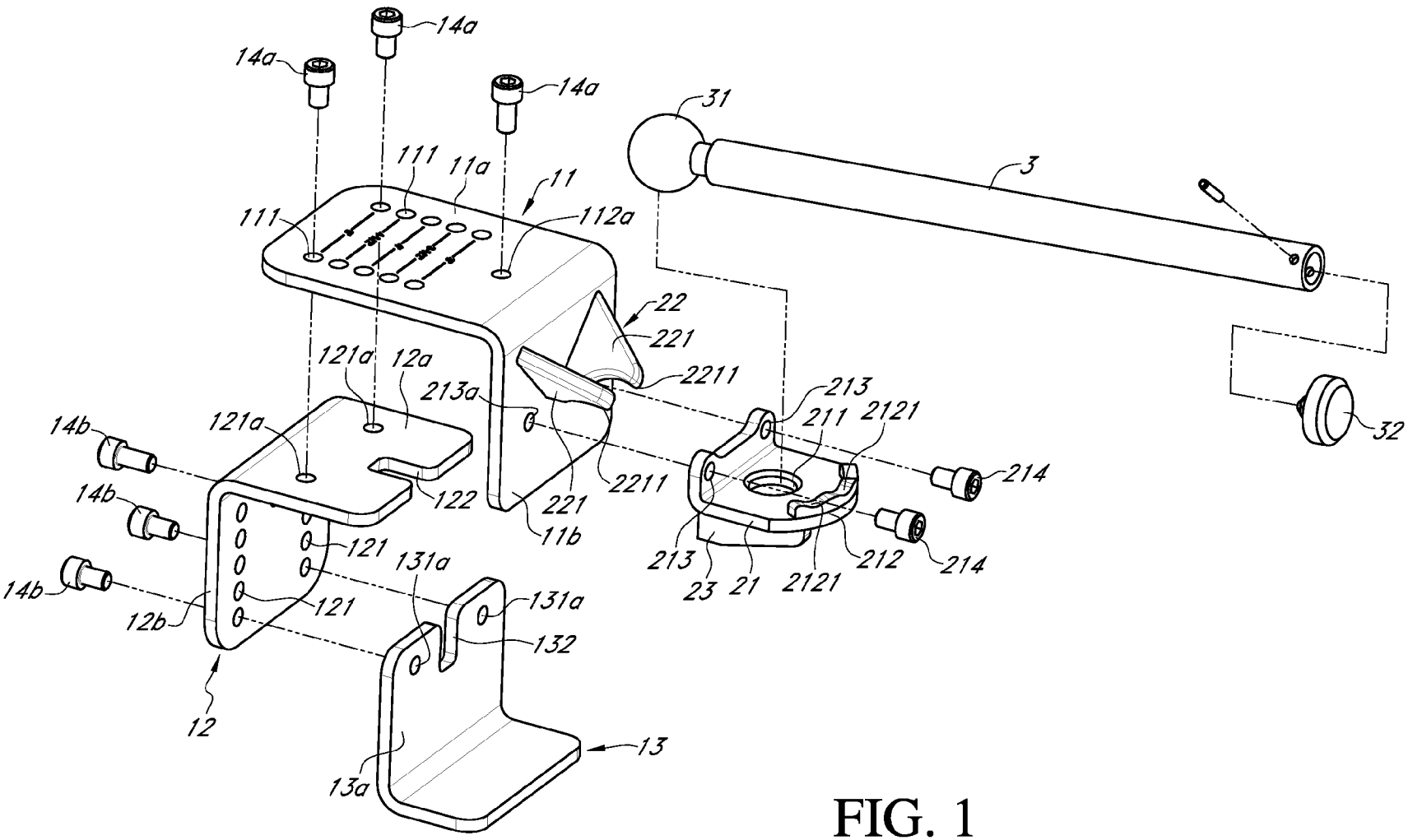
FIG. 1 is an exploded perspective view of a wheel rack, according to one embodiment of the invention.

Embodiments of the present invention provide a type of adjustable wheel rack in combination with a vehicle lift system to provide an easily adaptable and accessible station to store a wheel, facilitating vehicle maintenance work.

The wheel rack is described in detail with reference to FIGS. 1 through 6. The rack includes a locking frame plate 1, a stopper plate 13, a ball seat 2, a locking seat 22, and a rod 3.

Figure 2:
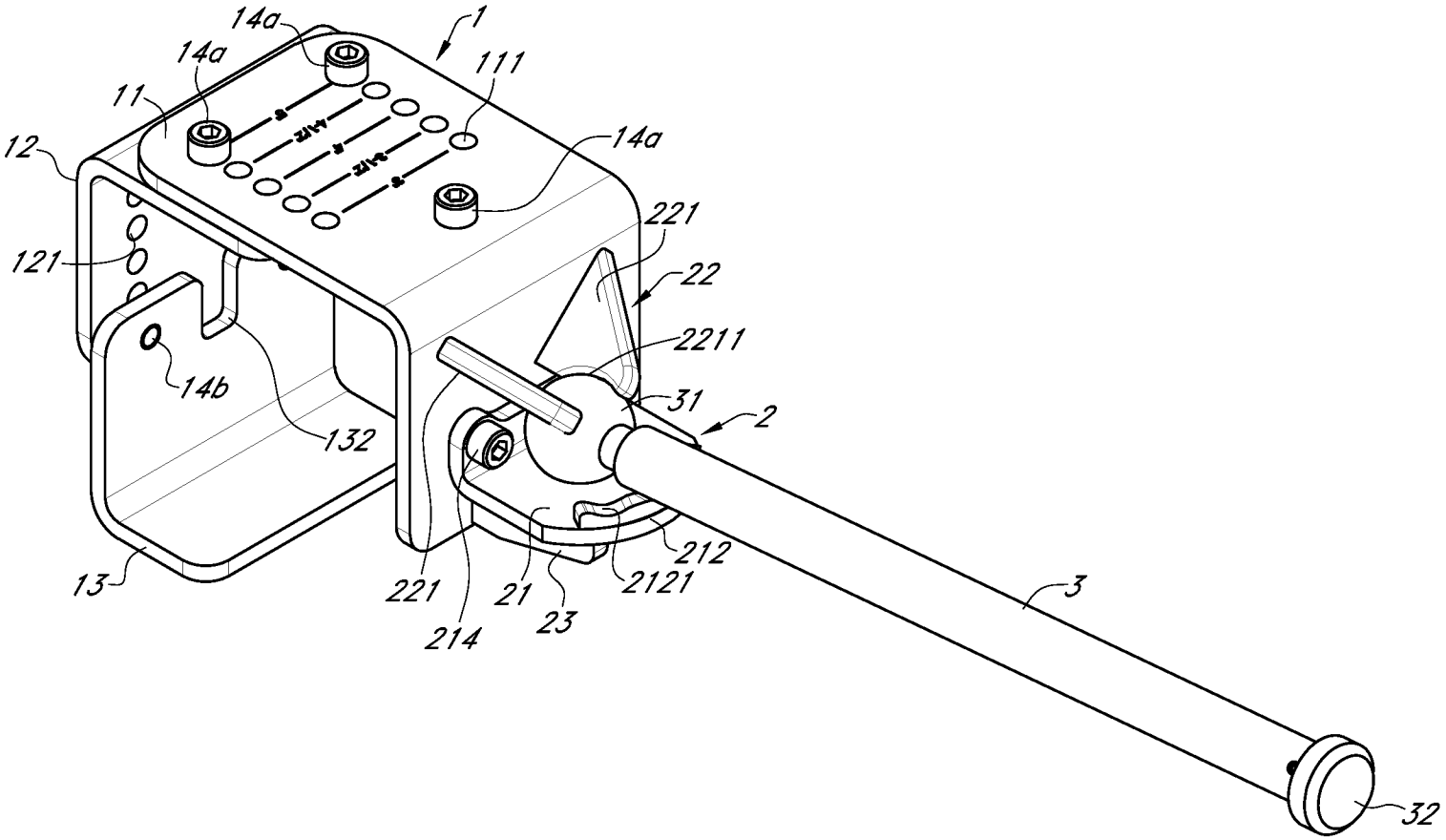
FIG. 2 is a perspective view of the wheel rack of FIG. 1.

The locking frame plate 1 may be formed, for example, by fastening together a first L-shaped plate 11 and a second L-shaped plate 12. A horizontal contact surface 11*a* of the first L-shaped plate 11 contacts a horizontal contact surface 12*a* of the second L-shaped plate 12 in forming the locking frame plate 1. Bolt holes 111 may be drilled along the length of the horizontal contact surface of the first L-shaped plate 11*a*. For example, FIGS. 1 and 2 show five rows of bolt holes 111 drilled into the horizontal contact surface 11*a* at intervals of 3", 3-½", 4", 4-½", and 5". Additional or fewer bolt holes 111 may be drilled into the horizontal contact surface 11*a*, and some embodiments may include continuous elongated slots instead of individual holes.

While reference is made herein to bolts 14*a*, 14*b*, 214 and bolt holes 111, 121, 121*a*, 131*a*, 213, openings drilled or formed into the first L-shaped plate 11, the second L-shaped plate 12, or the stopper plate 13 may be configured to accept any satisfactory fastening member, such as a screw, pin, et cetera.

Corresponding bolt holes 121*a* drilled into the horizontal contact surface 12*a* of the second L-shaped plate 12 allow bolts 14*a* to be inserted through the bolt holes 111 to secure the two plates 11, 12 together.

A stopper plate 13 may be provided to further support the locking frame plate 1 on a side column 41 of vehicle lift 4. At least one row of spaced bolt holes 121 drilled on the vertical contact surface 12*b* of the second L-shaped plate 12 correspond to at least one row of spaced bolt holes 131*a* drilled into the stopper plate 13. Bolts 14*b*, or any other acceptable fastener, may be inserted through bolt holes 121, 131*a* to secure the vertical contact surface of the stopper plate 13*a* to the second L-shaped plate 12.

Figure 6:
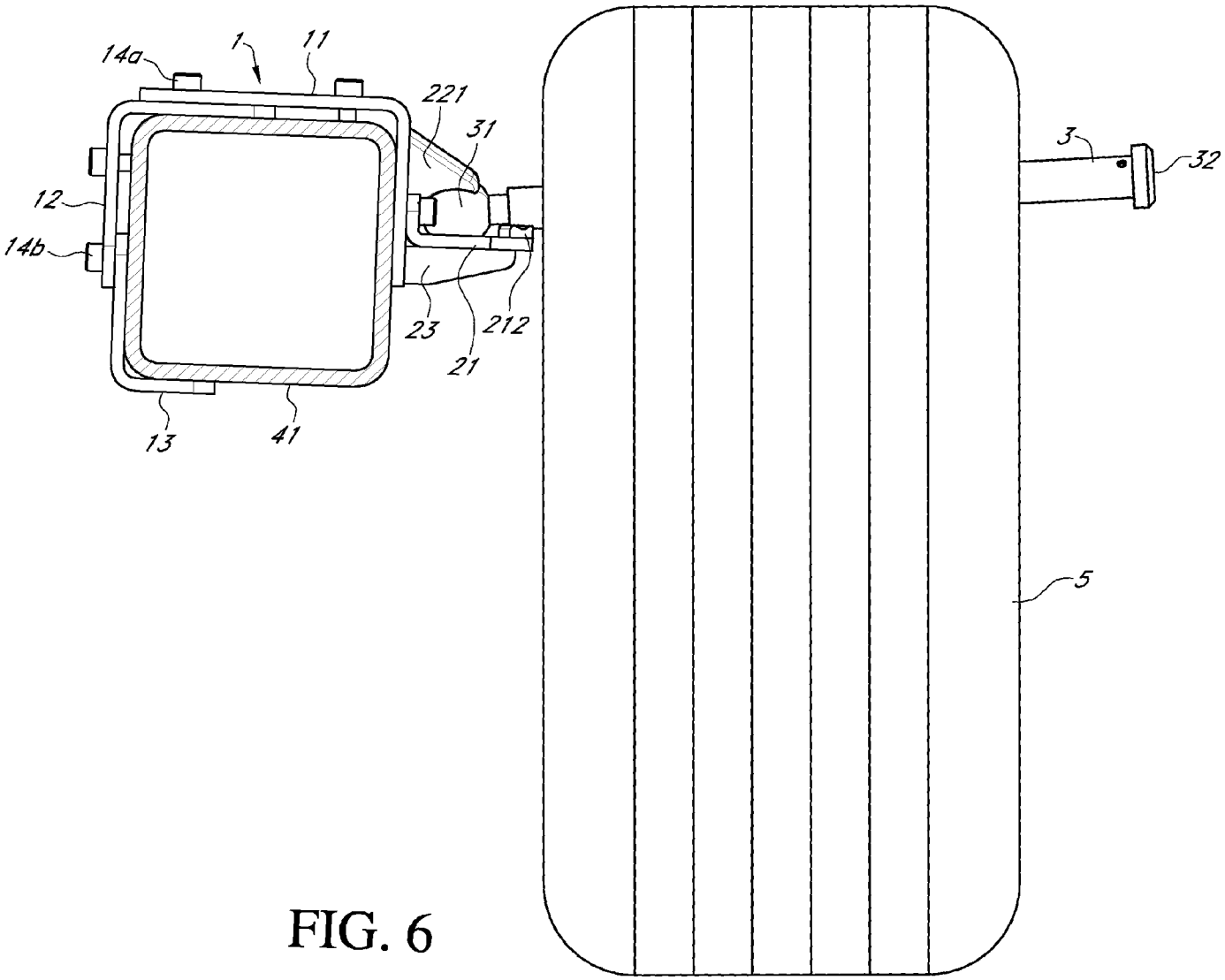
FIG. 6 is a side view, showing the wheel rack of FIG. 1 in use.

When the first L-shaped plate 11, the second L-shaped plate 12, and the stopper plate 13 are secured together, the locking frame plate 1 is configured to hug the side column 41, as shown in FIG. 6. The locking frame plate 1 may be adjusted by varying the connections discussed above to meet a particular size of the side column 41.

A thru hole 112*a* in the horizontal contact surface 11*a* of the first L-shaped plate 11 and a thru hole 112*b* in the vertical contact surface 12*b* of the second L-shaped plate 12 (FIG. 4) correspond to holes 122, 132 in the second L-shaped plate 12 and the stopper plate 13, respectively. Bolts 14*a* may be inserted into the thru holes 112*a*, 112*b* and concave holes 122, 132 to contact the side column 41 for ensuring that the locking plate 1 does not slip relative to the side column 41.

A scale may be provided on the outside edge of the horizontal contact surface 11*a* of the first L-shaped plate 11 (as shown in FIGS. 1 and 2) and on the outside edge of the vertical contact surface 12*b* of the second L-shaped plate 12 (FIG. 4) to allow users to easily identify dimensions. When the user determines the dimensions of the side column 41, he or she may then adjust the first L-shaped plate 11 and the second L-shaped plate 12 accordingly, and secure the two plates 11, 12 together via the bolts 14*a* or other acceptable fasteners inserted through the bolt holes 111, 121*a*. The second L-shaped plate 12 and the stopper plate 13 may be similarly adjusted.

A ball seat 2 and locking seat 22 may be attached to a vertical contact surface 11*b* of the first L-shaped plate 11, providing a support system for the rod 3. The ball seat 2 may include a ball receiving plate 21 and a support block 23, as shown in FIG. 1.

A cavity 211 in the ball receiving plate 21 receives a sphere 31 on the end of the rod 3, and the locking seat 22 prevents the sphere 31 (and thus the rod 3) from undesirably detaching. In one embodiment, the diameter of the cavity 211 may be slightly smaller than the diameter of the sphere 31 on the end of the rod 3 such that the sphere 31 sits on the cavity 211 without falling through. Additionally, this may allow the sphere 31, and thus the rod 3, to rotate on the ball receiving plate 21.

In some embodiments, the locking seat 22 includes at least two stopper plates 221 secured to the vertical contact surface 11*b* of the first L-shaped plate 11. Each stopper plate 221 has a curved surface 2211 to prevent the rod 3 from separating from the ball receiving plate 21 while allowing the rod 3 to pivot vertically and horizontally.

Figure 4:
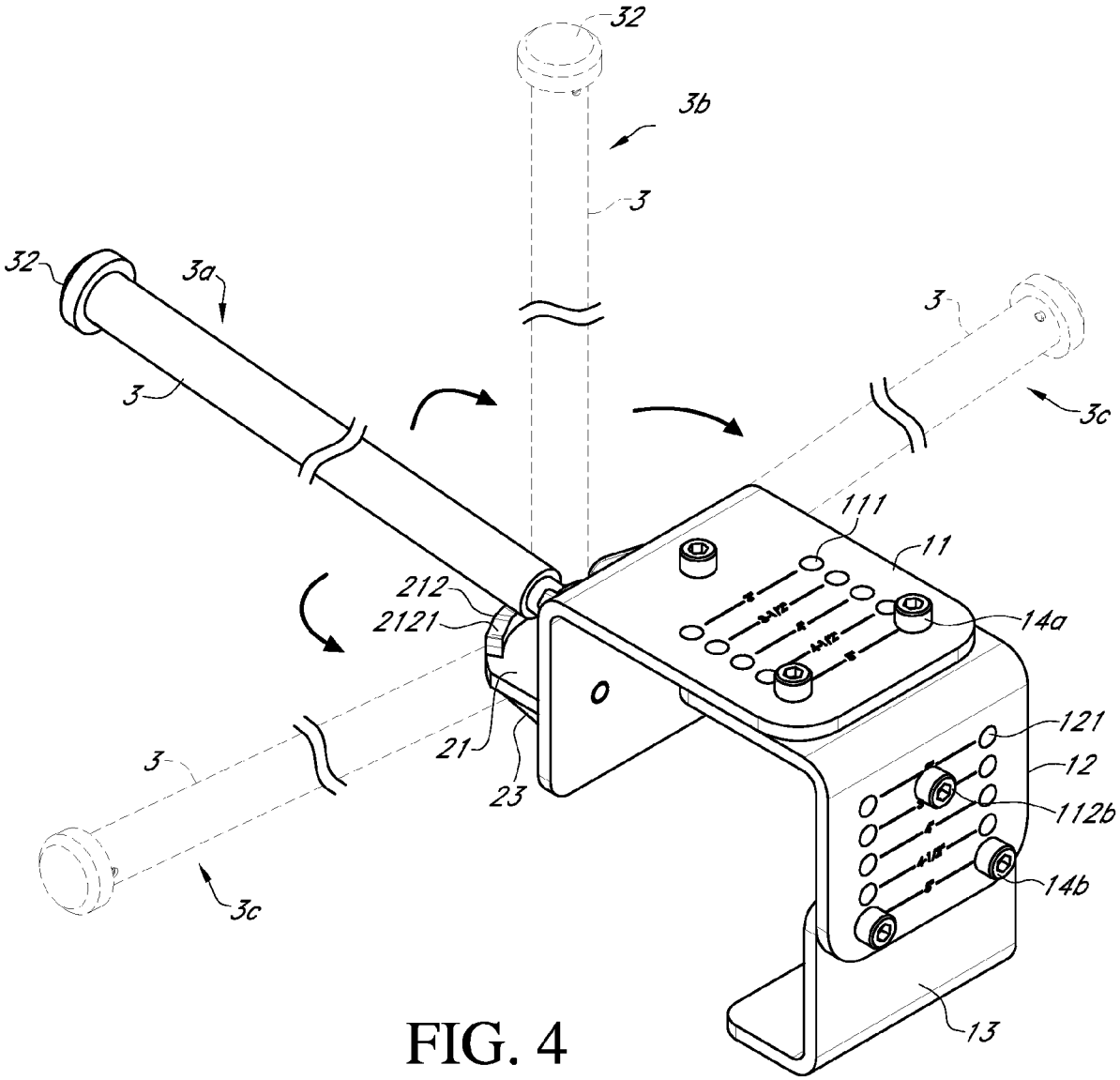
FIG. 4 is a perspective view of the wheel rack of FIG. 1 showing the rod in motion.
Figure 5:
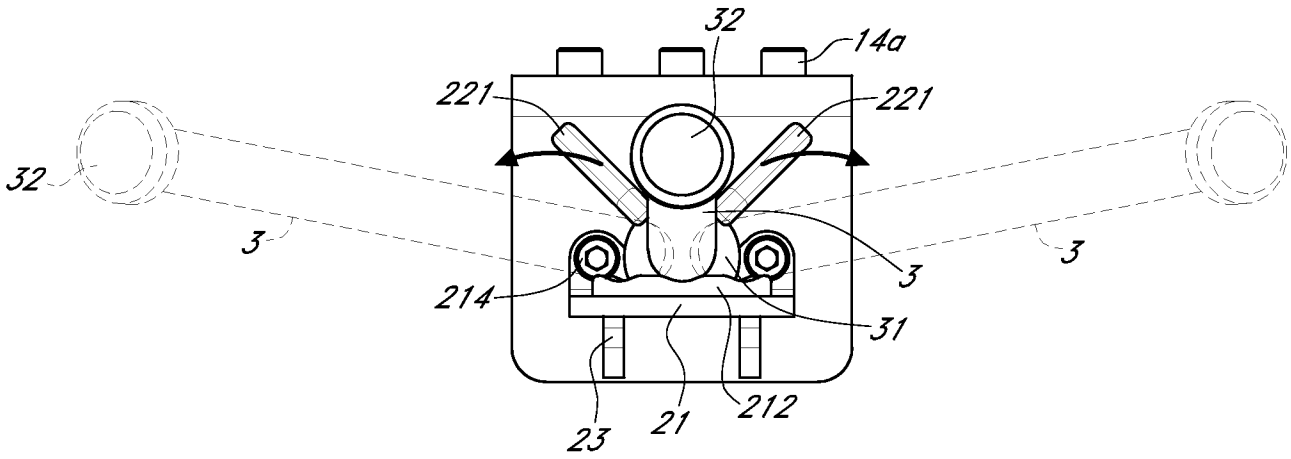
FIG. 5 is a front view of the wheel rack of FIG. 4 showing the rod in motion.

With reference to FIGS. 4 and 5, the rod 3 may be rotated from a ready-for-use position 3*a* (e.g., a substantially horizontal position wherein the rod 3 is perpendicular to the vertical support surface 11*b* of the first L-shaped plate 11) to a substantially vertical position 3*b* when the rod 3 is not in use. Alternatively, the rod 3 may be horizontally to substantially parallel to positions 3*c*.

When in the ready-for-use position 3*a*, the rod 3 may be supported by a protruding block 212 located, for example, on an outside edge of the ball receiving plate 21. The protruding block 212 may include various recessed arcs 2121 providing several options for positioning the rod 3 and inhibits movement of the rod 3. As shown in FIG. 5, the rod 3 may be positioned on-center, or at various angles off-center as the recessed arcs 2121 allow.

As may be seen in FIG. 5, the support blocks 23 positioned beneath the ball receiving plate 21 may be provided to further support the ball receiving plate 21 and the rod 3.

The ball receiving plate 21 may be secured to the vertical contact surface 11*b* of the first L-shaped plate 11 using any acceptable fastening means (e.g., welding, bolts, etc.). Holes 213 in the ball receiving plate 21 may be matched up with holes 213*a* drilled in the vertical contact surface 11*b* of the first L-shaped plate 11 to ensure correct placement of the ball receiving plate 21. Bolts 214 may be inserted into the holes 213 to secure the ball receiving plate 21 to the vertical contact surface 11*b* of the first L-shaped plate 11. Alternative means of securing the ball receiving plate 21 to the first L-shaped plate 11*b* (for example, welding or chemical bonding) may also be used.

The rod 3 may be cylindrical as shown in FIGS. 1-6. Alternatively, the rod 3 may be rectangular, hexagonal, or octagonal, for example. A stopper 32 may be provided at an opposite end of the rod 3 from the sphere 31 to prevent a wheel 5 from sliding off of the rod 3.

Figure 3:
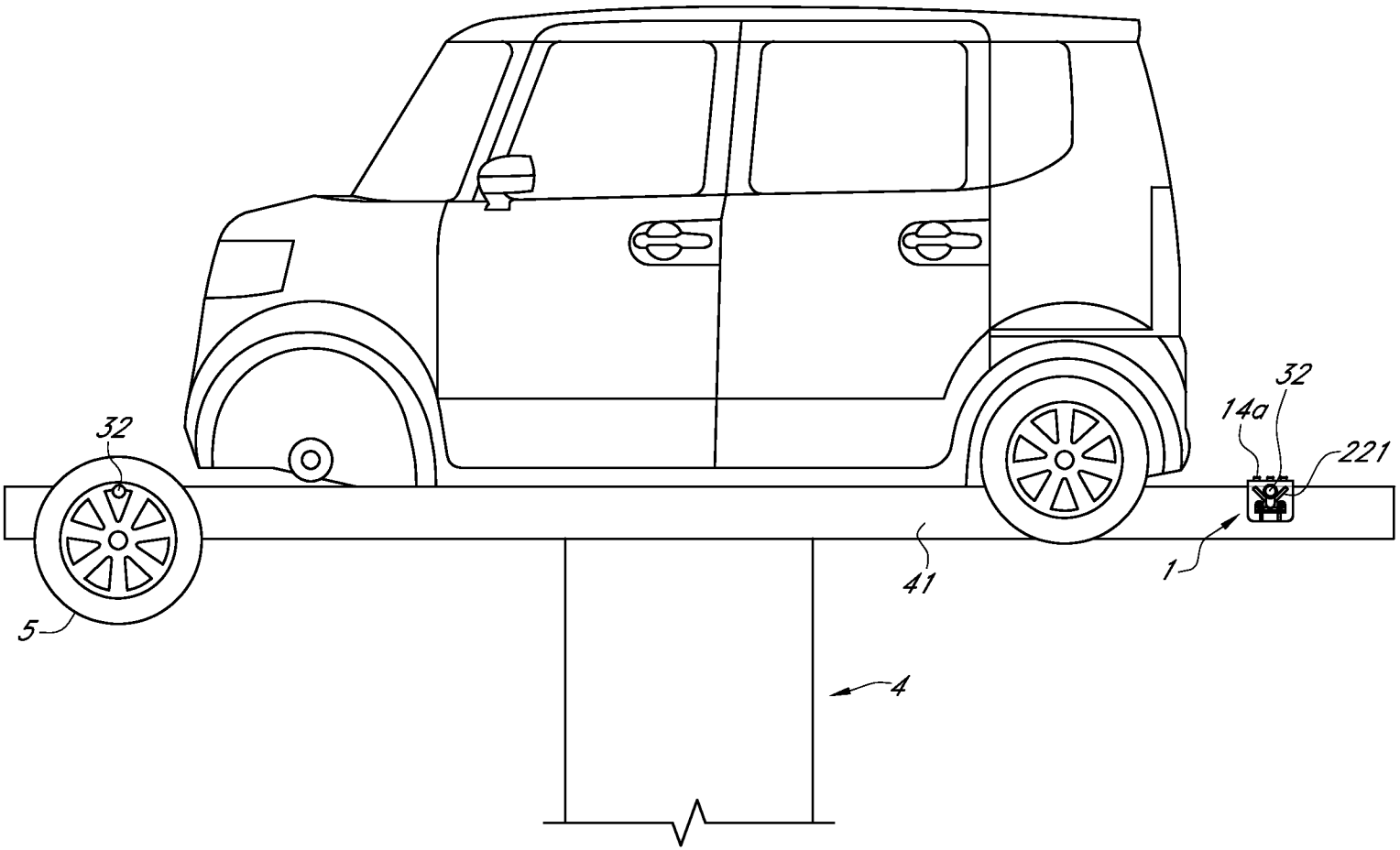
FIG. 3 is a front view, showing the wheel rack of FIG. 1 in use.

An example of the locking frame plate 1 in use with a vehicle lift 4 is shown in FIG. 3. A side column 41 provides support for a vehicle when the vehicle lift 4 is extended. The locking frame plate 1 may be positioned near the ends of the side column 41 as shown in FIG. 4. However, the locking frame plate 1 may be positioned anywhere on the side column 41 as is convenient for providing maintenance to the vehicle.

The wheel 5 may be positioned on the rod 3 (FIG. 6) while maintenance is being performed on the vehicle. The stopper 32 prevents the wheel 5 from slipping off the end of the rod 3. When maintenance on the vehicle is complete, the wheel 5 is removed from the rod 3, and secured to the vehicle.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A wheel rack, comprising:

a locking frame plate, comprising:

a first L-shaped plate;

a second L-shaped plate;

a stopper plate;

a ball seat fixed to the locking frame plate; and a rod having a first end with a sphere attached thereto, the sphere being received by the ball seat;

wherein:

the locking frame plate is configured to be fixed to a jamb of a vehicle lift;

the first L-shaped plate, the second L-shaped plate, and the stopper plate are adjustably secured together to fit around and be fixed to the jamb;

at least one aperture in a horizontal contact surface of the second L-shaped plate is configured to align with at least one aperture in a horizontal contact surface of the first L-shaped plate; and the first L-shaped plate and the second L-shaped plate are secured together by inserting at least one fastener through the aligned apertures of the first L-shaped plate and the second L-shaped plate.

2. The wheel rack of claim 1, wherein the horizontal contact surface of the first L-shaped plate has at least two rows of apertures such that first L-shaped plate and the second L-shaped plate are adjustably secured together.

3. The wheel rack of claim 1, wherein the at least one fastener is selected from the group consisting of: bolts, screws, pins, and rivets.

4. The wheel rack of claim 1, wherein the rod is configured to receive and hold a wheel of a vehicle.

5. A wheel rack, comprising:

a locking frame plate, comprising:

a first L-shaped plate;

a second L-shaped plate;

a stopper plate;

a ball seat fixed to the locking frame plate; and a rod having a first end with a sphere attached thereto, the sphere being received by the ball seat;

wherein:

the locking frame plate is configured to be fixed to a jamb of a vehicle lift;

the first L-shaped plate, the second L-shaped plate, and the stopper plate are adjustably secured together to fit around and be fixed to the jamb;

at least one aperture in the vertical contact surface of the stopper plate is configured to align with at least one aperture in a vertical contact surface of the second L-shaped plate; and the second L-shaped plate and the stopper plate are secured together by inserting at least one fastener through the aligned apertures in the first L-shaped plate and the second L-shaped plate.

6. The wheel rack of claim 5, wherein the vertical contact surface of the second L-shaped plate has at least two rows of apertures such that the second L-shaped plate and the stopper plate are adjustably secured together.

7. The wheel rack of claim 5, wherein the at least one fastener is selected from the group consisting of: bolts, screws, pins, and rivets.

8. The wheel rack of claim of claim 5, wherein the rod further has a stopper on an opposing second end, and wherein the rod is configured to support a wheel between the first end and the second end.

9. A wheel rack, comprising:

a locking frame plate comprising:

a first L-shaped plate;

a second L-shaped plate; and a stopper plate;

a ball seat fixed to the locking frame plate;

a locking seat; and a rod having an end with a sphere attached thereto;

wherein:

the locking frame plate is configured to be fixed to a jamb of a vehicle lift; and the ball seat comprises:

a ball receiving plate having a cavity;

a protruding block; and a support block.

10. The wheel rack of claim 9, wherein the cavity is configured to accept the sphere on the end of the rod.

11. The wheel rack of claim 10, wherein the rod is configured to support a wheel of a vehicle.

12. The wheel rack of claim 9, wherein the protruding block is secured to the outer edge of the ball receiving plate and has at least one recessed area for accommodating the rod.

13. A wheel rack, comprising:

a locking frame plate comprising:

a first L-shaped plate;

a second L-shaped plate; and a stopper plate;

a ball seat fixed to the locking frame plate;

a locking seat; and a rod having an end with a sphere attached thereto;

wherein:

the locking frame plate is configured to be fixed to a jamb of a vehicle lift; and the locking seat comprises two plates secured to a vertical contact surface of the first L-shaped plate, each plate having a curved surface for securing the sphere on the end of the rod onto the ball seat.

14. The wheel rack of claim 13, wherein the sphere is rotatable between the ball receiving plate and the locking seat such that the rod is positioned substantially perpendicular to the vertical contact surface of the first L-shaped plate when in use and substantially parallel to the vertical contact surface of the first L-shaped plate when not in use.

15. The wheel rack of claim 14, wherein, when in use, the rod is configured to support a wheel of a vehicle.

16. A wheel rack, comprising:

a locking frame plate comprising:

a first L-shaped plate;

a second L-shaped plate; and a stopper plate;

a ball seat fixed to the locking frame plate;

a locking seat; and a rod having an end with a sphere attached thereto;

wherein:

the locking frame plate is configured to be fixed to a jamb of a vehicle lift; and the ball seat includes a ball receiving plate having a cavity and a protruding block, the protruding block being secured to the ball receiving plate and having at least one recessed area for accommodating the rod.

17. The wheel rack of claim 16, wherein the rod is configured to receive and hold a wheel of a vehicle.

18. A method for using a wheel rack, comprising:

providing a locking frame plate comprising:

a first L-shaped plate having a horizontal contact surface and a vertical contact surface;

a second L-shaped plate having a horizontal contact surface and a vertical contact surface; and a stopper plate having a vertical contact surface;

wherein at least one aperture in the horizontal contact surface of the first L-shaped plate and one aperture in the vertical contact surface of the second L-shaped plate are aligned and securely fastened using a fastener; and wherein at least one aperture in the vertical contact surface of the second L-shaped plate and one aperture in the vertical contact surface of the stopper plate are aligned and securely fastened using a fastener;

providing a rod having a first end and a second end, wherein a sphere is attached to the first end and a stopper is attached to the second end;

providing a ball seat fixed to the locking frame plate, the ball seat further comprising:

a ball receiving plate having a cavity; and a protruding block secured to the ball receiving plate, the protruding block having at least one recessed area for accommodating the rod;

providing a locking seat;

securing the sphere between the cavity of the ball receiving plate and the locking seat;

rotating the sphere such that the rod is in a substantially perpendicular position relative to the vertical contact surface of the first L-shaped plate;

placing the rod in the at least one recessed area of the protruding block; and placing a wheel on the rod.

* * * * *